US006318053B1

(12) United States Patent
Frank et al.

(10) Patent No.: US 6,318,053 B1
(45) Date of Patent: Nov. 20, 2001

(54) DEVICE FOR AUTOMATIC BUNDLING OF SHEETS

(75) Inventors: Ulrich Frank, Eichenau; Rainer Stoll; Ralf Linck, both of München; Hermann Kronbauer, Aschheim, all of (DE)

(73) Assignee: Giesecke & Devrient GmbH (DE)

( * ) Notice: Subject to any disclaimer, the term of this patent is extended or adjusted under 35 U.S.C. 154(b) by 0 days.

(21) Appl. No.: 09/423,236

(22) PCT Filed: May 6, 1998

(86) PCT No.: PCT/EP98/02672

§ 371 Date: Feb. 8, 2000

§ 102(e) Date: Feb. 8, 2000

(87) PCT Pub. No.: WO98/50272

PCT Pub. Date: Nov. 12, 1998

(30) Foreign Application Priority Data

May 7, 1997 (DE) ..... 197 19 239

(51) Int. Cl.[7] ..... B65B 11/00
(52) U.S. Cl. ..... 53/586; 53/528
(58) Field of Search ..... 53/528, 529, 553, 53/586, 228

(56) References Cited

U.S. PATENT DOCUMENTS 2,923,110 * 2/1960 Tamarin ..... 53/412
3,585,777 * 6/1971 Herman ..... 53/586
3,996,728 * 12/1976 Gentili ..... 53/389
4,167,841 * 9/1979 Camp ..... 53/586
4,617,784 * 10/1986 Golicz et al. ..... 53/586
4,989,397 * 2/1991 Tomac et al. ..... 53/586
5,433,061 * 7/1995 Hutchinson et al. ..... 53/415

FOREIGN PATENT DOCUMENTS

4206968 A1 9/1992 (DE) .
0304978 * 1/1989 (EP) .

* cited by examiner

*Primary Examiner*—Peter Vo
*Assistant Examiner*—Nathaniel Chukwurah
(74) *Attorney, Agent, or Firm*—Bacon & Thomas PLLC

(57) ABSTRACT

The invention relates to an apparatus for automatic bundling of sheet material, in particular bank notes, having a deposit device on which sheet material to be bundled is deposited as a precisely fitting stack, a sliding device moving the stack of sheets perpendicularly toward a foil supplied by a device whereby the stack is partly wrapped with the foil and supplied to a transport device. The invention is characterized in that the transport device has two parallel, vertically adjustable conveyer belts between which the stack with its partly surrounding foil is clamped and transported to a banding device, said stack being positioned by the conveyer belts such that the foil is guided around the stack by the banding device and connected into a band, thereby obtaining a bundled stack of sheets. Subsequently the bundled packet can be pushed onto a transport belt with the aid of a delivery pocket.

15 Claims, 7 Drawing Sheets

DEVICE FOR AUTOMATIC BUNDLING OF SHEETS

BACKGROUND OF THE INVENTION

This invention relates to an apparatus for automatic bundling of sheet material.

U.S. Pat. No. 3,996,728 describes such an apparatus for paper sheets wherein paper sheets are transported between two conveyer belts driven in synchronism to two plates disposed parallel at the same distance as the conveyer belts. The distance between the conveyer belts corresponds to the stack height. Since the upper plate is vertically adjustable, the distance between the plates can be adjusted in accordance with the height of the supplied stack. Before the paper sheets reach the plate plane, the plates move in the direction of a foil extending perpendicular to the plate plane. The stack of sheets guided between the plates by the conveyer belts thereby hits the foil so that the foil is carried with the stack. The stack of sheets is then conveyed out of the plate plane whereby the foil is cut to the right stack format. The stack of sheets is then supplied via a separate transport path to an apparatus which brings together and interconnects the two foil ends. The known packing apparatus therefore has relatively great dimensions. Further, the known packing apparatus offers insufficient flexibility in processing stacks of sheets having different heights since the distance between the conveyer belts and thus the maximum stack height between the conveyer belts is firmly preset.

The invention is thus based on the problem of proposing an apparatus of the abovementioned kind which has a space-saving design and offers high flexibility in bundling different stack formats.

Sheet material to be bundled is preferably clamped as a stack between two parallel conveyer belts, the distance between the conveyer belts being adaptable to the particular stack format by automatic vertical adjustment of the conveyer belts. This permits compensation of differences in stack height which are due for example to quality differences of the sheet material. For example, the stark height of bank notes can vary greatly despite the same number of bank notes to be bundled by reason of their different states (greatly soiled or little soiled). Further, clamping the stack of sheets between the conveyer belts permits exact positioning of sheet material while it is being banded. Since the conveyer belts are used for fixing the sheet material to be bundled, on the one hand, and for transporting the bundled sheet material for the purpose of further processing, on the other hand, one can achieve a compact structure of the bundling apparatus whereby the bander, which guides the foil around the stack of sheets positioned between the conveyer belts and connects it into a band, can be disposed between the supplied foil and the conveyer belts in space-saving fashion.

According to a development, sheet material to be bundled is deposited in a precisely fitting stack on a vertically adjustable lifting table and urged against an opposite plate until a defined pressing force is reached. Alternatively the sheet material can be deposited on the lifting table as a stack with a certain desired height without the sheet material being compressed with a predefined pressing force. The stack of sheets is then drawn in by the conveyer belts, the vertical adjustment readjusting the distance between the conveyer belts with the aid of a proximity switch so as to produce a continuous channel between the lifting table and a conveyer belt. Since vertical adjustment does not change the length of the toothed belt for driving the conveyer belts, it can be effected during operation of the conveyer belts without intervention by the operator. Vertical adjustment of the conveyer belts and also the lifting table thus permits processing of different sheet formats which vary in particular with respect to their stack height. One can also use different foil widths for bundling the sheet material, as well as adjust the foil position.

Further advantageous developments of the invention can be found in the description with reference to the figures, and the dependent claims.

BRIEF DESCRIPTION OF THE DRAWINGS

The invention will be explained in more detail in the following with reference to the figures, in which.

DETAILED DESCRIPTION

Figure 1:
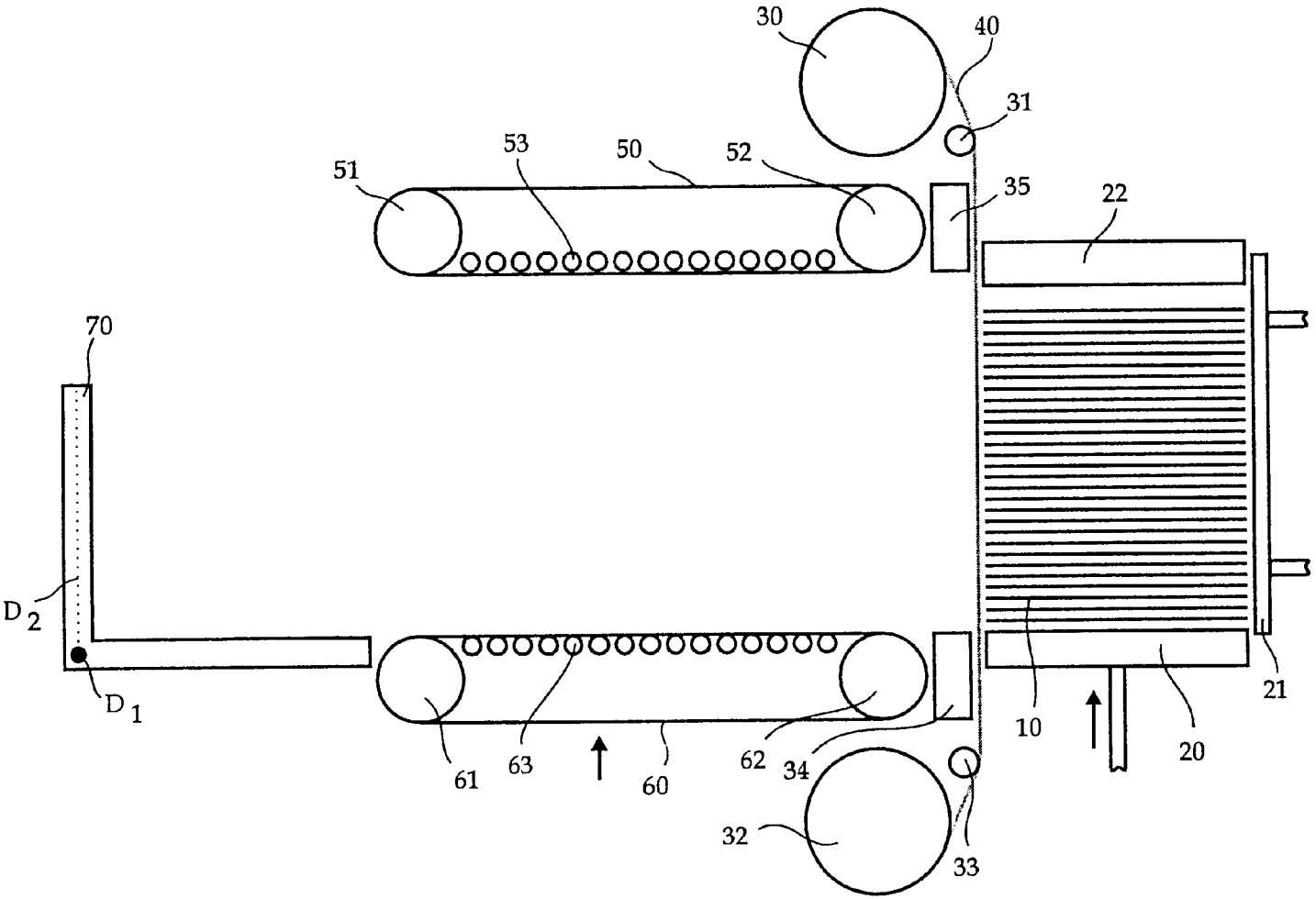
FIG. 1 shows the bundling apparatus in a side view.

FIG. 1 shows a schematic side view of the apparatus for bundling sheet material. In the following the bundling of sheet material will be described by way of example with reference to bank notes 10 deposited as loose sheet material in a precisely fitting stack on vertically adjustable lifting table 20. Bank notes can of course also be supplied to the lifting table in the form of individual banded packets stacked in a precisely fit. Opposite lifting table 20 is plate 22, shown here in the pressing position. Plate 22 is of displaceable design and can be moved from the pressing position shown here out of the plane of lifting table 20 so that lifting table 20 can be charged with bank notes from above. Before the bank- notes are bundled, lifting table 20 moves in the direction of plate 22, thereby compressing the stack of bank notes. Lifting table 20 is connected with a spring-mounted pneumatic cylinder (not shown here). Upon compression of the bank notes a compression spring, for example, is compressed which, when a defined pressing force on the bank-note stack has been reached, triggers a microswitch causing the lifting table to be braked pneumatically. Expeller 21 disposed laterally of lifting table 20 moves through the lifting table between comb slots (not shown here) but stops just in front of the welder terminal and the pressure die.

For bundling the bank notes, foil 40 is supplied in an endless form from a foil device including foil rollers 30 and 32 and guide elements 31, 33 arranged in a plane extending parallel to the leading edge of bank-note stack 10. Guide elements 31 and 33 are displaceable so that it is possible to adjust the foil position. For bundling one can use for example foils with a width of e.g. 75 to 106 mm. After welder terminal 35 and opposite pressure die 34 there are two conveyor belts 50, 60 disposed parallel to each other. Conveyer belts 50 and 60 are guided via deflection rollers 51, 52 and 61, 62, respectively. Conveyer belts 50 and 60 are driven in synchronism, the drive not being shown here. The distance of lower conveyer belt 60 from upper conveyer belt 50 can be adjusted by means of spindles (not shown) to compensate height differences in bank-note stacks. For delivery of the bank-note stack to conveyer belts 50 and 60, lower conveyer belt 60 is positioned so as to produce a continuous channel between lifting table 20 and conveyer belt 60. This is effected automatically with the aid of a proximity switch (not shown here). Upper conveyer belt 50 and lower conveyer belt 60 rest on spring-loaded roller beds 53, 63, respectively, so that it is possible to transport the stack of sheets in the clamped state. One thereby also compensates small differences in the thickness of the stack, which ensures reliable transport. Conveyer belts 50, 60 can transport the bundled bank-note stack to optional delivery pocket 70. Delivery pocket 70 is e.g. rotatable around rotation axes D1 and D2. Active transport with the aid of conveyer belts 50, 60 permits the bundling apparatus to be run completely empty. FIG. 1 shows the transport plane by way of example such that it extends horizontally. It can of course also extend obliquely, the bank-note stack always being supplied perpendicular to the transport plane.

Figure 2:
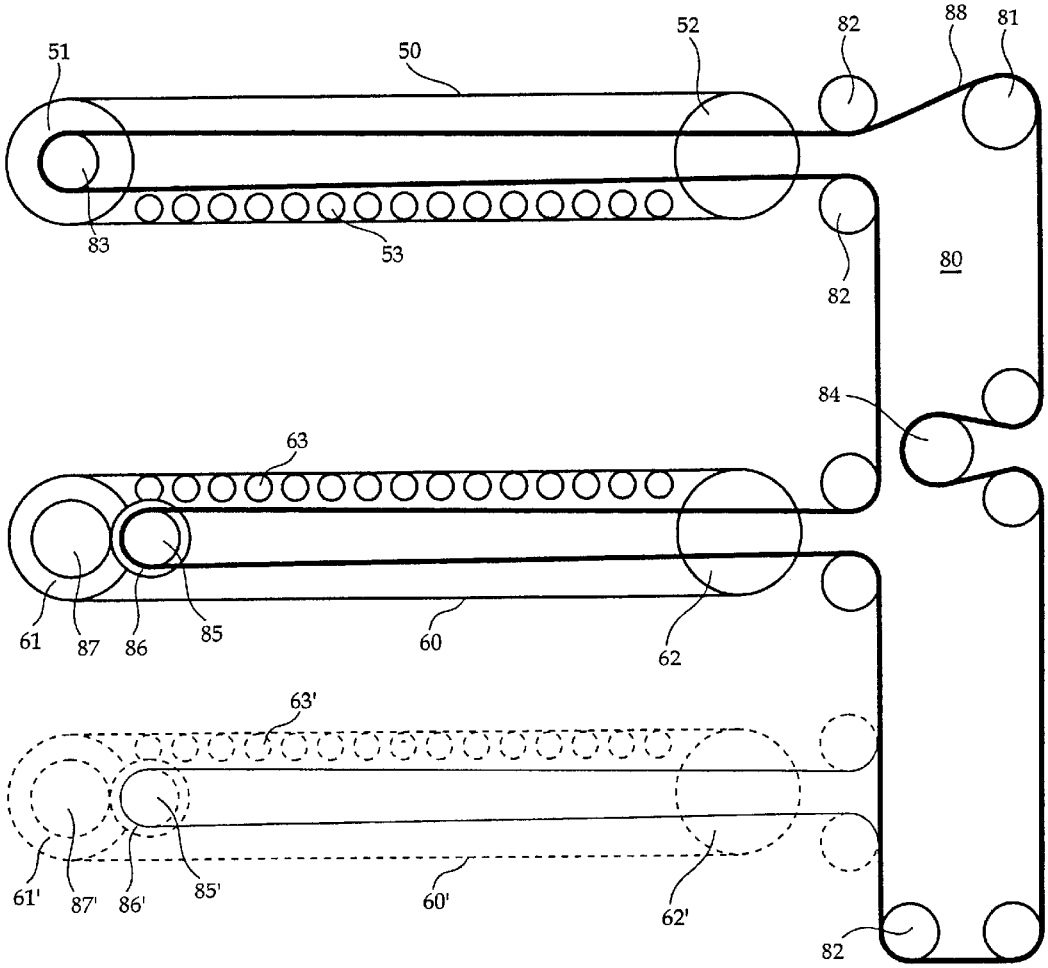
FIG. 2 shows the drive and vertical adjustment of the conveyer belts.

FIG. 2 shows a schematic side view of drive 80 for conveyer belts 50 and 60. Position 81 designates the driving pulley for toothed belt 88 guided via deflection rollers 82 onto roller 83 of the upper conveyer belt and roller 85 of the lower conveyer belt and onto eccentric tension roller 84. Positions 86 and 87 each show a toothed wheel for driving lower conveyer belt 60 which is driven in synchronism with upper conveyer belt 50. Lower conveyer belt 60 is vertically adjustable but without the length of the toothed belt being changed. This permits vertical adjustment during operation of the conveyer belts without intervention by the operator.

Figure 3:
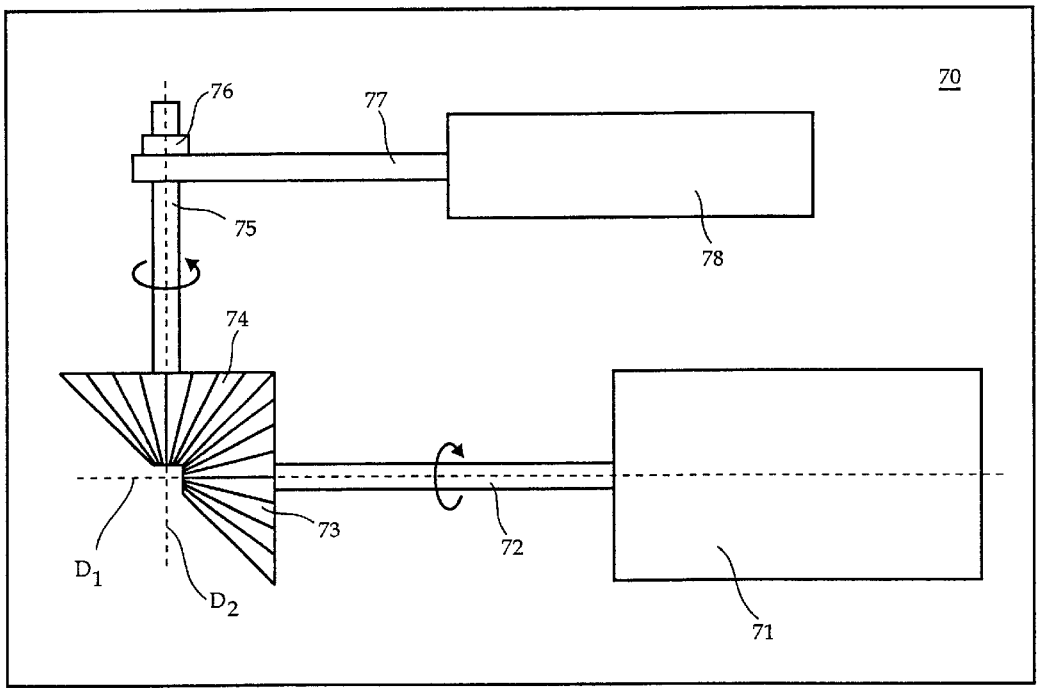
FIG. 3 shows the mode of operation of a delivery pocket.

FIG. 3 shows a block diagram of the operation of delivery pocket 70. Gear motor 71, with a reduction of about 1:350 for example, drives bevel gear pair 73, 74 disposed on shaft 72. The drive path of the motor is transmitted by bevel gear pair 73, 74 to swivel arm 75. The rotation of shaft 72 around first rotation axis D1 causes the bank-note stack to be set on the bank-note side edges. As soon as shaft 72 is in abutment, motor 71 rotates swivel arm 75 around second rotation axis D2. Gas compression spring 78 is connected via linkage 77 and lever 76 with swivel arm 75. Rotations D1 and D2 take place sequentially since second rotation D2 is inhibited by means of gas compression spring 78 until rotation D1 is ended. Second rotation D2 takes place as a relative motion of bevel gears 73 and 74. During second rotation D2 the motor holds swivel arm 75 in abutment until the bank-not-stack is unloaded. A microswitch (not shown here) ensures the upper position of the delivery pocket.

Figure 4A:
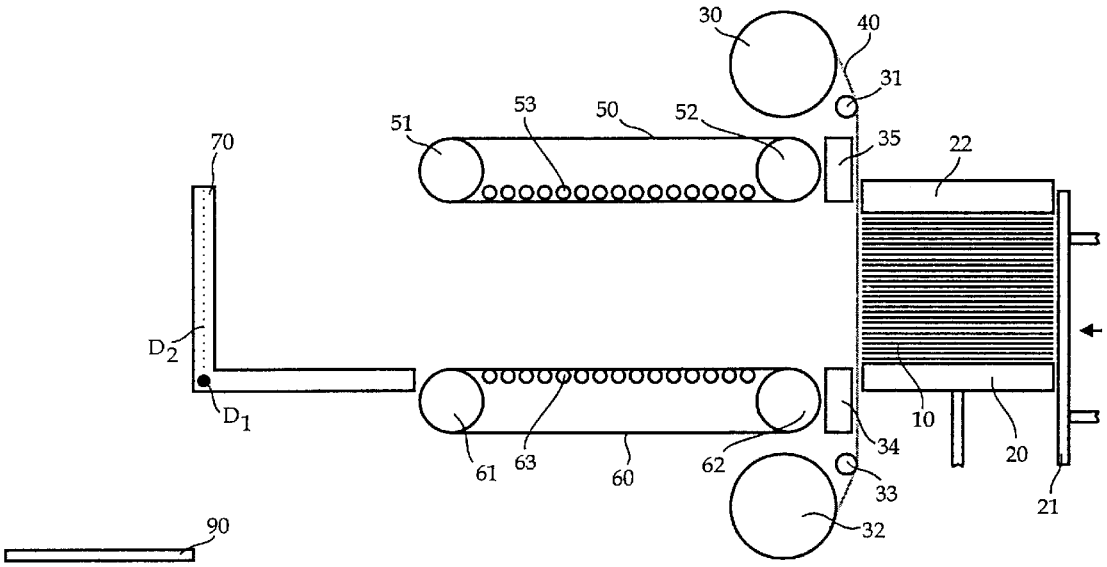
FIGS. 4*a*–4*g* show the operational sequence of the bundling apparatus.

FIGS. 4*a*–4*f* show the operational sequence of the inventive apparatus. FIG. 4*a* shows how sheet material 10 is urged by lifting table 20 against plate 22. Lower conveyer belt 60 is thereupon readjusted automatically so as to produce a continuous channel between the lifting table and the lower conveyer belt. This requires no intervention by the operator.

Figure 4B:
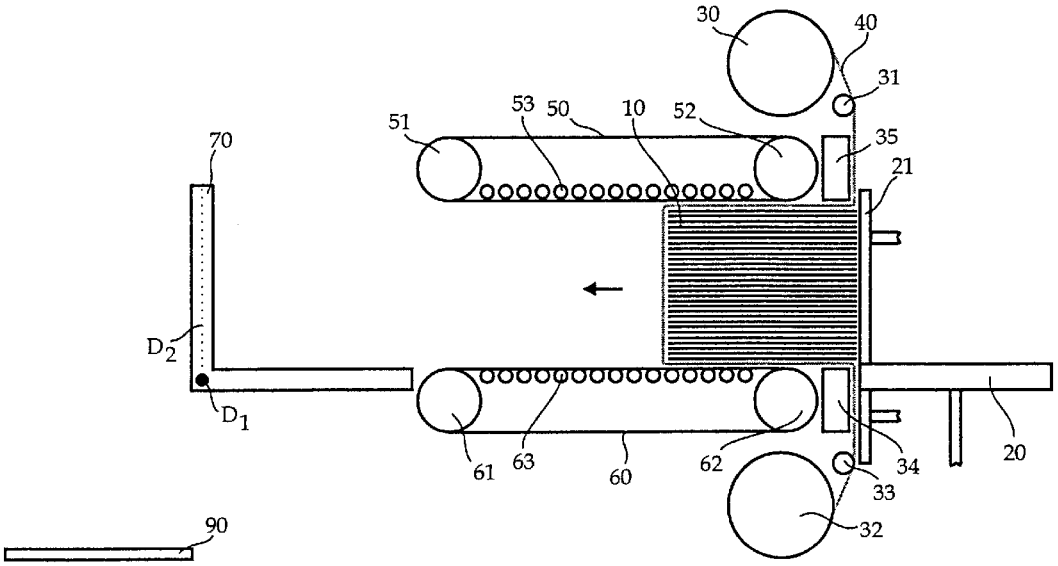
Figure 4C:
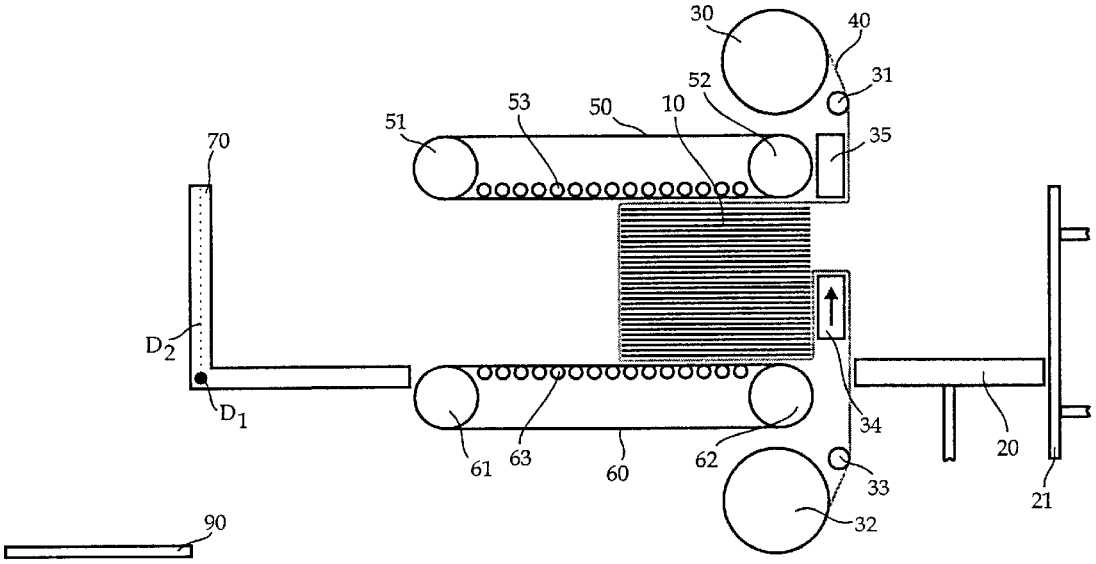
Figure 4D:
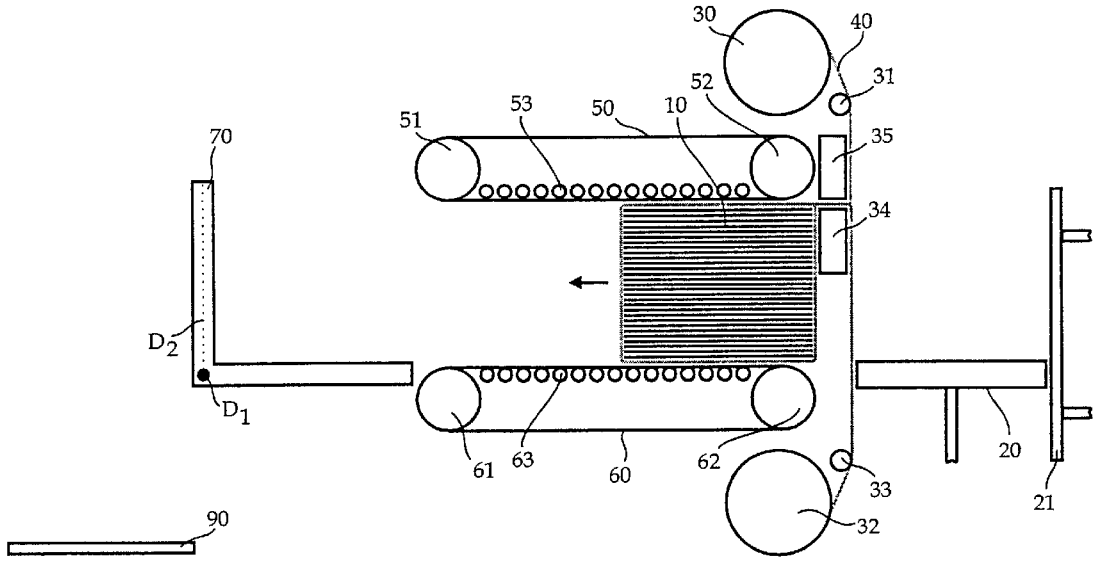

FIG. 4*b* shows expeller 21 as it delivers stack of sheets 10 to conveyer belts 50 and 60. Expeller 21 stops just in front of welder terminal 35 and pressure die 34. The motion executed by expeller 21 causes bank-note stack 10 to hit foil 40 and be wrapped partly therewith. Bank-note stack 10 is clamped with partly surrounding foil 40 between conveyer belts 50 and 60. The residual feed of the bank-note stack is then effected by the conveyer belts until the bank-note stack is located directly after welder terminal 35 and opposite pressure die 34, as shown in FIG. 4c. A light barrier (not shown here) can be used for example to ascertain the right reference position before foil 40 is brought together and connected. When this is the case, pressure die 34 moves in the direction of welder terminal 35, causing foil 40 to be connected between pressure die 34 and welder terminal 35 into band 41 and the latter to be separated from the foil, as shown in FIG. 4*d*. Bundled bank-note stack 11 can be surrounded by band 41 partly or over the whole area.

Figure 4E:
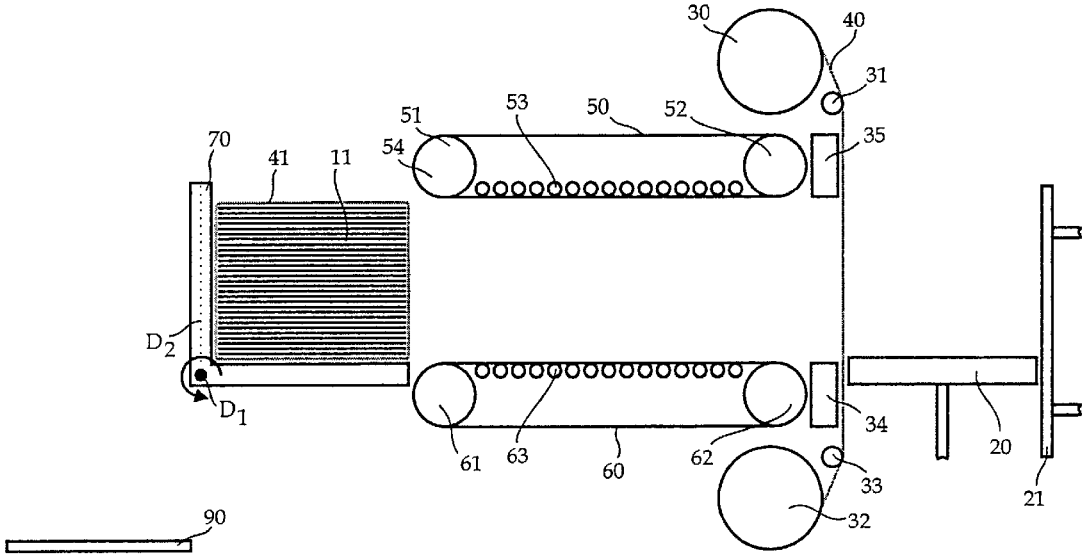
Figure 4F:
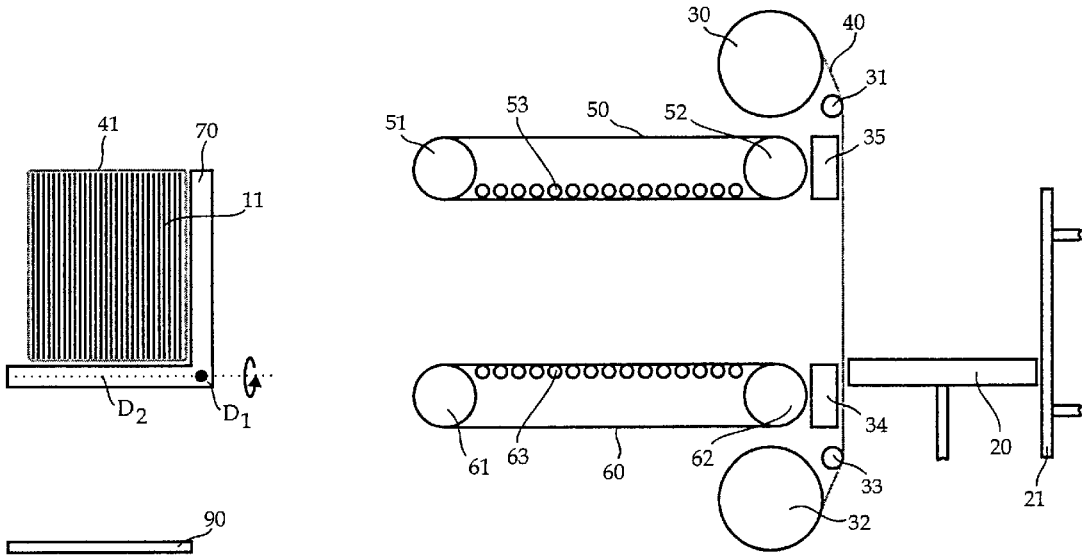
Figure 4G:
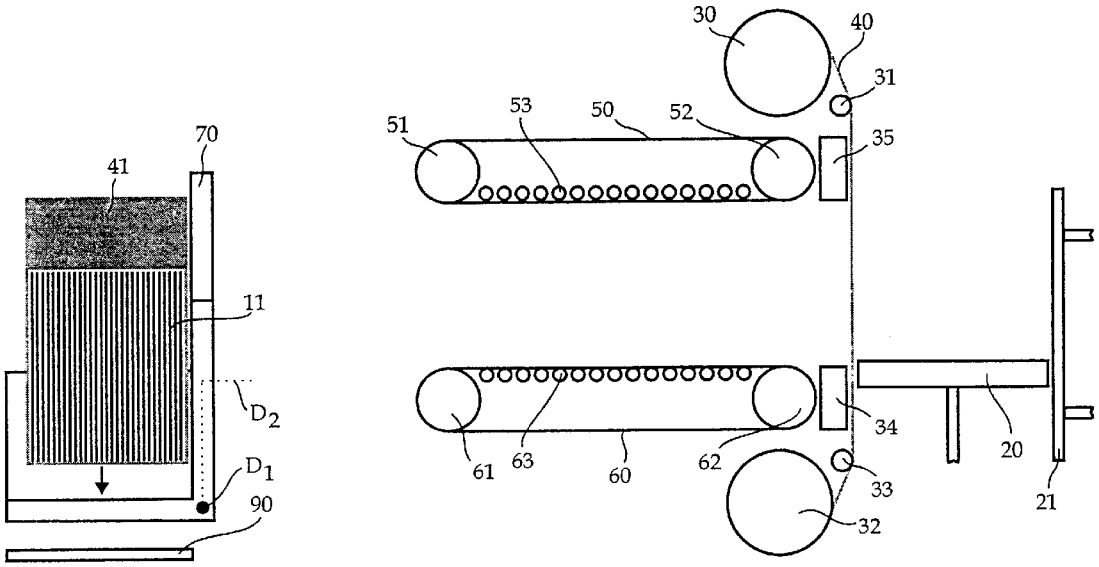

FIG. 4*e* shows bundled bank-note stack 11 transported by conveyer belts 50 and 60 to delivery pocket 70. The delivery pocket executes a first rotation around rotation axis D1, causing bundled bank-note stack 11 to be set on the bank-note side edges, as shown in FIG. 4*f*. As soon as the first rotation around rotation axis D1 is ended, a second rotation around rotation axis D2 is initiated. This second rotation causes bank-note stack 11 to be delivered parallel to transport belt 90, as shown in FIG. 4*g*. Second rotation D2 causes the delivery pocket to form an inclined plane and bank-note stack 11 to slide onto transport belt 90. The restoring motion of the delivery pocket is effected in the reverse order and is not shown here.

Figure 5:
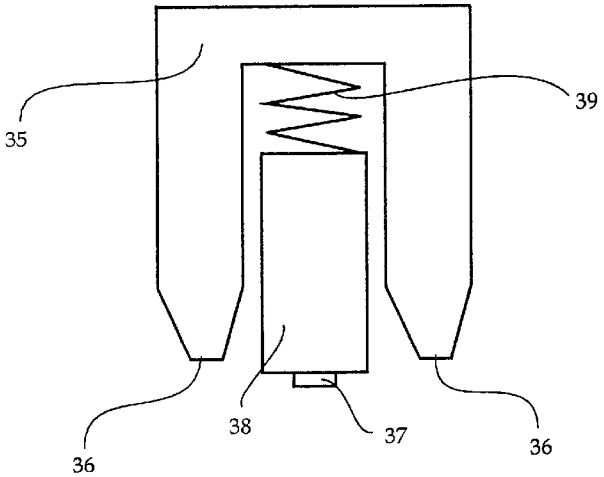
FIG. 5 shows a side view of the welder terminal of the banding device.

The lateral detail view of welder terminal 35 in FIG. 5 shows a design with a U-shaped cross section. The two arms each form holding-down means 36 between which heatable crimped wire 37 is disposed. Crimped wire 37 is fastened to wire holder 38 guided displaceably in the welder terminal and loaded by spring 39 in the direction of pressure die 34. Spring 39 urges wire holder 38 against a stop (not shown) so that crimped wire 37 protrudes beyond holding-down means 36 by a small measure.

When foil 40 is urged by the pressure die against welder terminal 35, as shown in FIG. 4*d*, crimped wire 37 is first acted upon and, since the pressure force of pressure die 34 is about four times as great as the counterforce through spring 38, displaced into the welder terminal until the pressure die hits stationary holding-down means 36 and clamps foil 40. The weld is thus always loaded by spring 39 with constant force and foil 40 held on both sides of the weld by holding-down means 36, which achieves high quality of the weld with simple means.

What is claimed is:

1. An apparatus for automatic bundling of sheet material, comprising a deposit device (20) on which sheet material (10) to be bundled is deposited as a precisely fitting stack, a sliding device (21) moving the stack of sheets perpendicularly toward a foil (40) supported by a foil device, the stack (10) having a height and being partly wrapped with the foil (40) and fed onto a transport device including upper and lower conveyer belts (50, 60) disposed parallel to each other and one above the other for positioning the stack relative to a banding device (34, 35) such that the foil (40) is guided around the back end of the stack (10) by the banding device (34, 35) and connected into a band (41), thereby obtaining a bundled stack of sheets (11), wherein the deposit device (20) is lifting table vertically adjusted to a predetermined vertical position according to the stack height, and the lower conveyor belt (60) is vertically adjusted automatically to the vertical position so as to produce a continuous channel between the lifting table (20) and the lower conveyor belt (60) thereby clamping the stack partly wrapped with foil between the conveyor belts (50, 60).

2. An apparatus according to claim 1, wherein the banding device has a welder terminal (35) and a pressure die (34) disposed opposite at a certain distance and adapted to be moved perpendicular to the welder terminal.

3. An apparatus according to claim 2, wherein the welder terminal (35) has two holding-down means (36) between which an elastically prestressed heating element (37) is provided.

4. An apparatus according to claim 1, wherein the conveyer belts (50, 60) are synchronously driven by a drive device (80) and arranged so that vertical adjustment of the lower conveyor belt (60) does not change the length of the toothed belt (88) of the drive device.

5. An apparatus according to claim 1, wherein the conveyer belts (50, 60) rest on a spring-loaded roller bed (53, 63).

6. An apparatus according to claim 1, wherein the lifting table (20) urges the stack of sheets (10) against a rotatable plate (22) disposed opposite the lifting table and the motion of the lifting table is stopped when a defined pressing force on the sheet material has been reached.

7. An apparatus according to claim 1, wherein the sliding device (21) moves the stack (10) from the lifting table (20) between the conveyor belts (50, 60), the lower conveyer belt (60) forming a continuous channel with the lifting table, and the sliding device (21) stopping in front of the banding device (34, 35).

8. An apparatus according to claim 1, wherein the bundled stack of sheets (11) is transported by the transport device (50, 60) to a delivery device (70).

9. An apparatus according to claim 8, wherein the delivery device (70) executes a first rotation around a first rotation axis (D1), causing the bundled stack of sheets (11) to be set on a side edge.

10. An apparatus according to claim 9, wherein the delivery device executes a second rotation around a second rotation axis (D2), the rotations (D1, D2) being executed by the delivery device (70) sequentially.

11. An apparatus according to claim 10, wherein the first and second rotations are effected with the aid of a bevel gear pair (73, 74), the bevel gear pair (73) being driven via a shaft (72) by a motor (71) and the first rotation being effected around the shaft (72) up to a first stop and the second rotation being transmitted as a relative motion of the bevel gears (73, 74) to a swivel arm (75).

12. An apparatus according to claim 11, wherein the swivel arm (75) is connected via a level (76) and a linkage (77) with a gas compression spring (78).

13. An apparatus according to claim 12, wherein the second rotation causes an inclined plane to be formed and the bundled stack of sheets (11) to be delivered from the inclined plane to a transport belt (90) extending parallel to the inclined plane.

14. An apparatus according to claim 10, wherein the second rotation causes an inclined plane to be formed and the bundled stack of sheets (11) to be delivered from the inclined plane to a transport belt (90) extending parallel to the inclined plane.

15. An apparatus according to claim 13, wherein the swivel arm (75) is connected via a lever (76) and a linkage (77) with a gas compression spring (78).

* * * * *